US005721418A

United States Patent [19]

Hazan et al.

[11] Patent Number: 5,721,418

[45] Date of Patent: Feb. 24, 1998

[54] FLAT-IRON HAVING NATURE OF FABRIC DETECTOR AND A MOVABLE SOLEPLATE HINGED BY SPRINGS AND FIXED BY AN ELECTROMAGNET

[75] Inventors: Jean-Pierre Hazan, Sucy; Jean-Louis Nagel, Limeil-Brevannes, both of France

[73] Assignee: U.S. Philips Corporation, New York, N.Y.

[21] Appl. No.: 612,153

[22] Filed: Mar. 7, 1996

[30] Foreign Application Priority Data

Mar. 8, 1995 [FR] France ..... 95 02710

[51] Int. Cl.[6] ..... D06F 75/26

[52] U.S. Cl. ..... 219/257; 38/81

[58] Field of Search ..... 219/257, 256, 219/258, 259, 245, 530, 540; 38/80, 81, 82, 74–75, 79, 93

[56] References Cited

U.S. PATENT DOCUMENTS

| | | | |
|---|---|---|---|
| 2,076,614 | 4/1937 | Bowman | 38/74 |
| 2,122,694 | 7/1938 | Muller | 38/82 |
| 3,760,149 | 9/1973 | Harsanyi | 219/247 |
| 5,345,060 | 9/1994 | Hazan et al. | 219/250 |

FOREIGN PATENT DOCUMENTS

| | | | |
|---|---|---|---|
| 0523793B1 | 1/1993 | European Pat. Off. . | |
| 0523794A1 | 1/1993 | European Pat. Off. . | |
| 685417 | 6/1930 | France | 219/259 |
| 2709138 | 2/1995 | France . | |
| 526640 | 6/1931 | Germany | 219/259 |
| 1540975 | 1/1970 | Germany | 219/258 |
| 3430060 | 3/1985 | Germany . | |
| 6-54999 | 3/1994 | Japan . | |
| 568396 | 4/1945 | United Kingdom | 219/258 |
| 9107068 | 5/1991 | WIPO | 219/540 |

*Primary Examiner*—Teresa J. Walberg
*Assistant Examiner*—Raphael Valencia
*Attorney, Agent, or Firm*—Ernestine C. Bartlett; Norman N. Spain

[57] ABSTRACT

A flat-iron (5) comprises a fixed soleplate (10) against which a movable soleplate (14) is engageable in order to guarantee a safe use both for the user and for the fabric to be ironed. The soleplate (14) can be brought into contact with the fixed soleplate (10) with the aid of an electromagnet (12), which is controlled by a state-of-use detector (11) and/or a nature-of-fabric detector (27) coupled to the thermostat.

15 Claims, 1 Drawing Sheet

FLAT-IRON HAVING NATURE OF FABRIC DETECTOR AND A MOVABLE SOLEPLATE HINGED BY SPRINGS AND FIXED BY AN ELECTROMAGNET

FIELD OF THE INVENTION

The invention relates to a flat-iron comprising a fixed soleplate, means for heating the fixed soleplate, a thermostat for controlling the temperature of the fixed soleplate, and a movable soleplate hinged to the fixed soleplate by elastic means.

A flat-iron with a movable soleplate makes it possible to rapidly lower the temperature of the soleplate that comes into contact with the fabric to be ironed by moving the movable soleplate away from the fixed soleplate. This precludes damage to the fabric in the case that the temperature of the fixed soleplate is too high. It also precludes burns as a result of contact with a soleplate having a high temperature.

BACKGROUND OF THE INVENTION

A flat-iron of this type is described in U.S. Pat. No. 2,076,614, which relates to a flat-iron having a fixed soleplate and a movable soleplate, which can either be brought into contact with or moved away from the fixed soleplate. The user can choose one position or the other position by means of a lever. When the lever is released the movable soleplate moves automatically away from the fixed soleplate under the influence of a spring arranged in a holder situated between the two soleplates.

With such a flat-iron it is necessary that the user himself takes the step of actuating the lever in order to change the position of the movable soleplate.

SUMMARY OF THE INVENTION

It is the object of the invention to achieve that the user himself need not take this step of positioning the movable soleplate but merely restricts himself to normal use of the flat-iron.

This object is achieved with a flat-iron comprising an electromagnet secured to the fixed soleplate, means for energizing the electromagnet, the movable soleplate being adapted to be attracted, at least locally, by the electromagnet, the elastic means being such that, firstly, they are capable of pushing the movable soleplate away from the fixed soleplate when the electromagnet is not energized and that, secondly, they allow the movable soleplate to be attracted by the electromagnet in order to be applied to the fixed soleplate when the electromagnet is energized.

Thus, the tilting position of the movable soleplate is determined by the means for energizing the electromagnet. The rate at which the temperature of the movable soleplate decreases depends on the thermal mass of the movable soleplate. Preferably, a movable soleplate with a low thermal mass is chosen.

The energizing means can take into account a state of use or non-use of the flat-iron. These energizing means may then comprise a detector for the state of use of the flat-iron, which detector deenergizes the electromagnet when the flat-iron is not in use. The state-of-use detector is, for example, an electrical switch actuated when a user holds the flat-iron, or any state-of-use detector which detects a motionless state of the flat-iron.

The energizing means can also take into account settings of the flat-iron, for example of the thermostat, selected by the user, the energizing means detecting whether the settings thus selected are compatible or not compatible with the nature of the fabric on which the flat-iron is placed. In that case, in a first variant, the energizing means may comprise a nature-of-fabric detector which deenergizes the electromagnet when the thermostat has settings which are not compatible with the nature of the fabric. In a second variant the energizing means may comprise a nature-of-fabric detector which energizes the electromagnet when the thermostat has settings which are compatible with the nature of the fabric.

The energizing means may combine the action of the state-of-use detector and that of the nature-of-fabric detector. Alternatively, said means may separately use one detector or the other detector.

BRIEF DESCRIPTION OF THE DRAWINGS

These and still other aspects of the invention will become apparent from and elucidated by means of the following description of embodiments.

The invention will be more fully understood with the aid of the following Figures given by way of non-limitative examples, in which.

DESCRIPTION OF EMBODIMENTS

Figure 1:
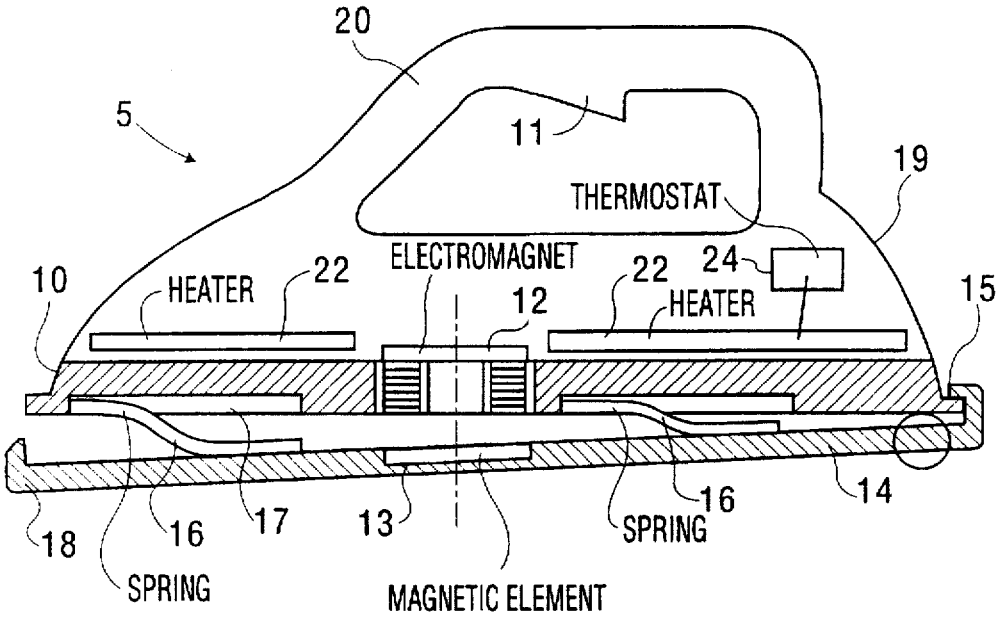
FIG. 1 shows a flat-iron in accordance with the invention.

FIG. 1 shows a flat-iron 5 comprising a fixed soleplate 10, a movable soleplate 14, a body 19 and a handle 20. The movable soleplate 14 preferably has a low thermal mass, for example by giving it a small thickness. The iron further comprises heating means 22 for the fixed soleplate and a thermostat 24 for controlling the temperature of the fixed soleplate. The fixed soleplate and the movable soleplate are hinged to one another about a hinge 15. The latter may be arranged at the rear, at the front or on a side of the soleplate of the flat-iron. Springs 16, which are preferably formed by a steel blade, are arranged between the two soleplates to vary the spacing between them. One of the ends of each blade is secured to one of the two soleplates, the other end being free to move depending on the variations of the spacing between the two soleplates. In the non-spaced position the springs engage in recesses 17 to allow contact between the two soleplates. It is possible to use other elastic means, for example spiral springs. The movable soleplate 14 is partly or wholly made of a ferromagnetic material (for example, soft iron). For example, an element 13 of a ferromagnetic material may be arranged in a movable soleplate made of a non-magnetic material on the basis of aluminum. A nose 18 enables the fixed soleplate 10 to engage in the movable soleplate 14.

The fixed soleplate 10 is provided with the electromagnet 12, which is flush with the surface of the fixed soleplate 10 facing the magnetic element 13 arranged in the movable soleplate. By energizing the electromagnet 12 this magnet can attract the magnetic element 13 and bring the two soleplates into contact with one another, as a result of which the movable soleplate is heated by the fixed soleplate. It is possible to use a plurality of electromagnets.

Figure 2:
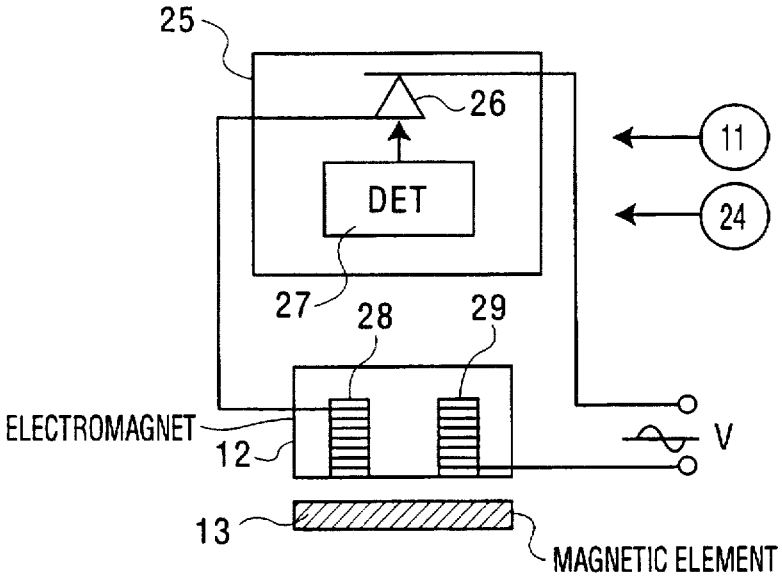
FIG. 2 is a diagram of the electrical part comprising the electromagnet and the energizing means for the electromagnet.

FIG. 2 shows the electromagnet 12 arranged opposite the magnetic element 13. The electromagnet 12 comprises coils 28, 29 connected in series with a power supply source V via energizing means 25 for said coils. The energizing means 25 comprise a switch 26, which can be closed or opened by a detector 27 for respectively energizing or deenergizing the coils of the electromagnet.

The energizing means 25 can be of different types. The detector 27 may be, for example, a state-of-use detector. This is, for example, an electrical switch 11 (FIG. 1) arranged in the handle of the flat-iron to energize the coils 28, 29 when a user holds the flat-iron.

The state-of-use detector may alternatively be a motion detector which detects movements of the iron. Such a detector is described, for example in European Patent Application EP 0,523,794 A1. It is an electrostatic detector which measures the amount of electrostatic charges produced in a fabric as the flat-iron moves over the fabric.

Detectors with tilting elements, such as those in which a drop of mercury tumbles, may be used or any other type of state-of-use detector. It may be, for example, a detector which detects the motionless state of the iron when placed with its fixed and movable soleplates in a vertical position. In this position the risk of burning is highest.

In the case that a state of non-use of the flat-iron is detected, both in a horizontal position and in a vertical position of the iron, the energizing means 25 deenergize the electromagnet, which causes the movable soleplate to be moved away and to cool rapidly, which protects the fabric against damage by overheating and/or precludes bunting. A visual or acoustic indicator may be activated to warn the user. The energizing means 25 may include a timing to set the instant at which the mechanisms are activated. When the iron is not connected to an electric power supply the security as a result of the spacing between the two soleplates remains operative.

The detector 27 may be a nature-of-fabric detector, for example the detector described in European Patent Application EP 0,523,794 A1. It is an electrostatic detector which determines the nature of the fabric depending on the amount of electrostatic charges produced in a fabric as the flat-iron moves over the fabric.

For the purpose of protecting the fabric two variants may be envisaged.

In a first variant the user sets the thermostat and starts ironing, the two soleplates being in contact with one another. The nature-of-fabric detector then determines the nature of the fabric and decides if the settings selected by the user are compatible or not compatible with the detected nature of the fabric: synthetics, cotton, silk . . . If the settings are not compatible the energizing means 25 deenergize the electromagnet, causing the movable soleplate to be moved away and to cool rapidly. This tilting movement warns the user of the detected incompatibility, enabling him to take action by selecting new thermostat settings. For an additional warning of the user a visual or acoustic indicator may be activated.

In the second variant the nature-of-fabric detector activates the electromagnet only when the settings of the flat-iron are compatible with the detected nature of the fabric. For this purpose, ironing is started with the movable soleplate spaced from the fixed soleplate. Thus, even with a fixed soleplate having a high temperature, the movable soleplate will remain at a low temperature, which does not cause any damage to the fabric. The nature of the fabric can then be detected by the nature-of-fabric detector, which also determines if the settings of the thermostat selected by the user are compatible or not compatible with the detected nature of the fabric. If the settings are compatible, the energizing means energize the coils of the electromagnet, as a result of which the movable soleplate is tilted against the fixed soleplate. In the opposite case, this tilting does not take place. The fact that no tilting takes place may be enough to warn the user of the detected incompatibility. In addition to this, a visual or acoustic indicator may be activated.

To improve the quality of the thermal contact between the movable soleplate and the fixed soleplate a thermally conducting coating may be provided on either of the soleplates. This may be a thin layer consisting of, for example, a polymer loaded with a thermally conductive material (loaded silicone). Preferably, the coating has an elasticity which is adequate to ensure that the movable soleplate engages correctly with the fixed soleplate.

Figure 3:
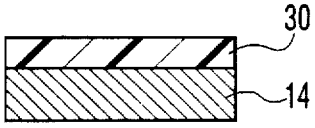
FIG. 3 is an enlarged view of a section of a soleplate provided with a thermally conducting coating.

FIG. 3 shows an enlarged view of a section of the soleplate 14 provided with a layer 30 of such a thermally conductive coating.

We claim:

1. A flat-iron (5) comprising a fixed soleplate (10), means (22) for heating the fixed soleplate, a thermostat (24) for controlling the temperature of the fixed soleplate, and a movable soleplate (14) articulated to the fixed soleplate round a first hinge (15) and further hinged to the fixed soleplate by elastic means, characterized in that it comprises an electromagnet (12) secured to the fixed soleplate (10), means (25) for energizing the electromagnet, the movable soleplate being adapted to be attracted, at least locally, by the electromagnet, the elastic means (16) being such that, firstly, they are capable of pushing the movable soleplate (14) away from the fixed soleplate (10) when the electromagnet (12) is not energized and that, secondly, they allow the movable soleplate to be attracted by the electromagnet in order to be applied to the fixed soleplate when the electromagnet is energized.

2. A flat-iron as claimed in claim 1, characterized in that the energizing means (25) comprise a detector (27) for the state of use of the flat-iron, which detector deenergizes the electromagnet (12) when the flat-iron is not in use.

3. A flat-iron as claimed in claim 2 wherein the energizing means (25) comprise a nature-of-fabric detector (27) which deenergizes the electromagnet (12) when the thermostat (24) has settings which are not compatible with the nature of the fabric.

4. A flat-iron as claimed in claim 2 wherein the energizing means (25) comprise a nature-of-fabric detector (27) which energizes the electromagnet (12) when the thermostat (24) has settings which are compatible with the nature of the fabric.

5. A flat-iron as claimed in claim 2 wherein a thermally conducting coating is disposed between the movable soleplate and the fixed soleplate to improve the thermal contact.

6. A flat-iron as claimed in claim 2, characterized in that the state-of-use detector (25) comprises an electrical switch (11) which is actuated when a user grips the flat-iron.

7. A flat-iron as claimed in claim 6 wherein the energizing means (25) comprise a nature-of-fabric detector (27) which deenergizes the electromagnet (12) when the thermostat (24) has settings which are not compatible with the nature of the fabric.

8. A flat-iron as claimed in claim 6 wherein the energizing means (25) comprise a nature-of-fabric detector (27) which energizes the electromagnet (12) when the thermostat (24) has settings which are compatible with the nature of the fabric.

9. A flat-iron as claimed in claim 6 wherein a thermally conducting coating is disposed between the movable soleplate and the fixed soleplate to improve the thermal contact.

10. A flat-iron as claimed in claim 1, wherein the energizing means (25) comprise a nature-of-fabric detector (27) which deenergizes the electromagnet (12) when the thermostat (24) has settings which are not compatible with the nature of the fabric.

11. A flat-iron as claimed in claim 10 wherein the energizing means (25) comprise a nature-of-fabric detector (27) which energizes the electromagnet (12) when the thermostat (24) has settings which are compatible with the nature of the fabric.

12. A flat-iron as claimed in claim 10 wherein a thermally conducting coating is disposed between the movable soleplate and the fixed soleplate to improve the thermal contact.

13. A flat-iron as claimed in claim 1, wherein the energizing means (25) comprise a nature-of-fabric detector (27) which energizes the electromagnet (12) when the thermostat (24) has settings which are compatible with the nature of the fabric.

14. A flat-iron as claimed in claim 13 wherein a thermally conducting coating is disposed between the movable soleplate and the fixed soleplate to improve the thermal contact.

15. A flat-iron as claimed in claim 1, wherein a thermally conducting coating is disposed between the movable soleplate and the fixed soleplate to improve the thermal contact.

* * * * *